US006063533A

United States Patent [19]

Yanus et al.

[11] Patent Number: 6,063,533

[45] Date of Patent: May 16, 2000

[54] GENERATOR LAYER SENSITIZATION THROUGH TRANSPORT LAYER DOPING

[75] Inventors: John F. Yanus, Webster; Damodar M. Pai, Fairport; Timothy J. Fuller, Pittsford; Dennis J. Prosser, Walworth; Susan M. Vandusen, Williamson, all of N.Y.

[73] Assignee: Xerox Corporation, Stamford, Conn.

[21] Appl. No.: 09/398,304

[22] Filed: Sep. 20, 1999

[51] Int. Cl.[7] ..... G03G 5/047

[52] U.S. Cl. ..... 430/58.75; 430/58.8; 430/132

[58] Field of Search ..... 430/58.65, 58.75, 430/58.8, 132

[56] References Cited

U.S. PATENT DOCUMENTS 4,869,988 9/1989 Ong et al. ..... 430/58.65
4,988,595 1/1991 Pai et al. ..... 430/58.8
4,999,268 3/1991 Ojima et al. ..... 430/58.65
5,529,868 6/1996 Mashimo et al. ..... 430/58.65

*Primary Examiner*—Roland Martin

[57] ABSTRACT

An electrophotographic imaging member including a supporting substrate, an undercoat layer, a charge generating layer comprising photoconductive pigment particles, film forming binder and a charge transport layer formed from a coating solution, the coating solution comprising charge transporting molecules, the charge transporting molecules comprising a major amount of a first charge transport molecule comprising an alkyl derivative of an arylamine and a minor amount of second transport molecule comprising an alkyloxy derivative of an arylamine.

the charge generating layer being located between the substrate and the charge transport layer. A process for fabricating this imaging member is also disclosed.

2 Claims, No Drawings

GENERATOR LAYER SENSITIZATION THROUGH TRANSPORT LAYER DOPING

BACKGROUND OF THE INVENTION

This invention relates in general to electrophotography and more specifically, to an improved electrophotographic imaging member having an a more sensitive charge generating layer through transport layer doping.

In the art of electrophotography, an electrophotographic plate comprising a photoconductive insulating layer on a conductive layer is imaged by first uniformly electrostatically charging surface of the photoconductive insulating layer. The plate is then exposed to a pattern of activating electromagnetic radiation such as light, which selectively dissipates the charge in the illuminated areas of the photoconductive insulating layer while leaving behind an electrostatic latent image in the non-illuminated areas. This electrostatic latent image may then be developed to form a visible image by depositing finely divided electroscopic toner particles on the surface of the photoconductive insulating layer. The resulting visible toner image can be transferred to a suitable receiving member such as paper. This imaging process may be repeated many times with reusable photoconductive insulating layers.

Electrophotographic imaging members are usually multilayered photoreceptors that comprise a substrate support, an electrically conductive layer, an optional hole blocking layer, an adhesive layer, a charge generating layer, and a charge transport layer in either a flexible belt form or a rigid drum configuration. For most multilayered flexible photoreceptor belts, an anti-curl layer is usually employed on the back side of the substrate support, opposite to the side of the electrically active layers, to render the desired photoreceptor flatness. One type of multilayered photoreceptor comprises a layer of finely divided particles of a photoconductive inorganic compound dispersed in an electrically insulating organic resin binder. In U.S. Pat. No. 4,265,990 a layered photoreceptor is disclosed having separate charge generating (photogenerating) and charge transport layers. The charge generating layer is capable of photogenerating holes and injecting the photogenerated holes into the charge transport layer. The photogenerating layer utilized in multilayered photoreceptors include, for example, inorganic photoconductive particles or organic photoconductive particles dispersed in a film forming polymeric binder. Inorganic or organic photoconductive material may be formed as a continuous, homogeneous photogenerating layer. Many suitable photogenerating materials known in the art can be utilized, if desired.

As more advanced, higher speed electrophotographic copiers, duplicators and printers were developed, degradation of image quality was encountered during extended cycling. Moreover, complex, highly sophisticated, duplicating and printing systems employed flexible photoreceptor belts, operating at very high speeds, have also placed stringent mechanical requirements and narrow operating limits as well on photoreceptors. Advanced photoreceptors have excellent electrical and mechanical properties. Some have very stable electrical performance over long life, for example, up to at least 200K cycles. However, many photoreceptors exhibit fluctuations in photosensitivity from batch to batch even where every effort is made to ensure identical processing conditions such as the milling of charge generation layer pigment dispersion under the same conditions. For example, when extrinsic photosensitive pigments are employed, the photogenerated carriers must be brought out of the surface of pigment particles before the carriers recombine and move into the charge transport layer under the applied electric field. This process slows down considerably in binders containing dispersed extrinsic photosensitive pigment particles such as benzimidazole perylene particles, especially at low applied electric fields. Under these conditions, the photoinduced discharged curve (PIDC) becomes softer at low field. Such a soft PIDC curve requires more powerful, bulky and expensive laser light sources for imaging in an electrophotographic printer or duplicator. The expression photoinduced discharged curve (PIDC) as employed herein is defined as a relationship between the potential as a function of exposure and is a measure of the sensitivity of the device. It generally represents the supply efficiency (number carriers injected from the generator layer into the transport layer per incident photon) as a function of the field across the device.

INFORMATION DISCLOSURE STATEMENT

U.S. Pat. No. 5,863,686 to Yuh et al., issued Jan. 26, 1999—An electrophotographic member comprising a supporting substrate, an undercoat layer doped with a donor molecule, a charge generator layer comprising photoconductive pigment particles, film forming binder and a donor molecule dissolved in the film forming binder and a charge transport layer the charge generating layer being located between the substrate and the charge transport layer. The donor molecule dissolved in the film forming binder comprising poly vinyl butyral is selected from the group consisting of N,N'-diphenyl-N,N'bis(3-hydroxyphenyl)-[1,1'-biphenyl]-4,4'diamine, N,N'-di(3-methoxyphenyl)-N,N'-diphenyl -[1,1'-biphenyl]-4,4'diamine and mixtures thereof.

U.S. Pat. No. 5,992,498 to Yuh et al., issued Jul. 13, 1999—An electrophotographic member including a supporting substrate, an undercoat doped with an acceptor molecule, a charge generator layer comprising photoconductive pigment particles, film forming binder and an acceptor molecule represented by a specific structure dissolved in the film forming is binder and a charge transport layer.

U.S. Pat. No. 5,437,950 issued to Yu et al. on Aug. 1, 1995—An electrophotographic imaging member is disclosed including a substrate, an optional blocking layer, an optional thermoplastic adhesive interface layer, a thin charge generation layer comprising pigment particles dispersed in a film forming polymer binder having dissolved or molecularly dispersed therein an electron accepting/transporting compound, and a charge transport layer.

U.S. Pat. No. 4,725,518 issued to Carmichael et al. on Feb. 16, 1988—An electrophotographic imaging device comprising a charge generating layer and charge transport layer is disclosed in which an aromatic amine compound and a protonic acid or Lewis acid is added to the charge transport layer to control the dark development and background potentials of the imaging device.

U.S. Pat. No. 5,342,719 to Pai et al., on Aug. 30, 1994—an electrophotographic imaging member including a charge generator layer, a charge transport layer with a charge transport molecules and as sensitizing additive or dopant a hydroxy derivative of the transport molecule.

U.S. Pat. No. 5,356,741 issued to Carmichael et al. in Oct. 10, 1994—An electrophotographic imaging device comprising a charge generating layer and charge transport layer is disclosed involving the incorporation of at least weak acid or a weak base and the conjugated salt of the weak acid or weak base to reduce variations in the dark development potential an the background potential of the imaging device.

U.S. Pat. No. 4,874,682 issued to Scott et al. on Oct. 1989—An electrophotographic imaging device comprising a charge generating layer and charge transport layer is disclosed in which a monomeric or polymeric non-volatile basic amine is incorporated in the charge transport layer to eliminate the fatigue effects of acids.

U.S. Pat. No. 5,792,582 to Yuh et al., issued August 11, 1998—An electrophotographic member including a supporting substrate, a charge generator layer comprising photoconductive pigment particles, a first film forming binder and 2,6-di-tert-butyl-4-methylphenol, and a charge transport layer.

Thus, there is a continuing need for photoreceptors having improved sensitivity, and for tools or controls to adjust the sensitivity of the photoreceptor to meet consistently meet exacting specifications in spite of batch to batch variations in the quality of the various component materials, especially the photoconductive pigment.

BRIEF SUMMARY OF THE INVENTION

It is, therefore, an object of the present invention to provide an improved electrophotographic imaging member and process for fabricating the imaging member.

It is another object of the present invention to provide an improved electrophotographic imaging member having greater sensitivity.

It is yet another object of the present invention to provide a quality control tool or solution to bring the sensitivity of an electrophotographic imaging member within narrow specifications in spite of quality variations between component materials from batch to batch, especially photoconductive pigments.

It is still another object of the present invention to provide a quality control tool or knob to bring the sensitivity of an electrophotographic imaging member within narrow specifications without major changes in the dispersion quality of charge generator layer dispersion or without any major changes to the fabrication process of the device.

The foregoing objects and others are accomplished in accordance with this invention by providing an electrophotographic imaging member comprising a supporting substrate, an undercoat layer, a charge generating layer comprising
photoconductive pigment particles,
film forming binder and a charge transport layer comprising charge transporting molecules, the charge transporting molecules comprising a major amount of a first charge transport molecule comprising an alkyl derivative of an arylamine and a minor amount of second transport molecule comprising an alkyloxy derivative of an arylamine, the charge generating layer being located between the substrate and the charge transport layer.

This imaging member may be fabricated by forming an undercoat layer from a coating solution, forming a charge generating layer from a coating dispersion comprising
photoconductive pigment particles dispersed in
a solution of a film forming binder dissolved in a solvent for the binder, forming a charge transport layer from a coating solution comprising
charge transport molecules,
a film forming binder,
solvent for the binder, and drying the coating to form a charge transport layer overlying the charge generating layer, the charge transporting molecules comprising a major amount of a first charge transport molecule comprising an alkyl derivative of an arylamine and a minor amount of second transport molecule comprising an alkyloxy derivative of an arylamine.

Generally, electrophotographic imaging members comprise a supporting substrate, having an electrically conductive surface or coated with an electrically conductive layer, an optional charge blocking layer, an undercoat layer, a charge generating layer, a charge transport layer and an optional overcoating layer.

The substrate may be opaque or substantially transparent and may comprise numerous suitable materials having the required mechanical properties. Accordingly, this substrate may comprise a layer of an electrically non-conductive or conductive material such as an inorganic or an organic composition. The electrically conductive layer may comprise the entire supporting substrate or merely be present as a coating on an underlying rigid or flexible web member. Any suitable electrically conductive material may be utilized. Typical electrically conductive materials include, for example, aluminum, titanium, nickel, chromium, brass, gold, stainless steel, copper iodide, and the like. When the conductive layer is to be flexible, it may vary in thickness over substantially wide ranges depending on the desired use of the electrophotoconductive member. Accordingly, the conductive layer can generally range in thicknesses of from about 50 Angstrom units to about 150 micrometers. As electrically non-conducting materials there may be employed various thermoplastic and thermoset resins known for this purpose including polyesters, polycarbonates, polyamides, polyurethanes, and the like. The substrate may have any suitable shape such as, for example, a flexible web, rigid cylinder, sheet and the like.

The thickness of a flexible substrate support depends on numerous factors, including economical considerations, and thus this layer for a flexible belt may be of substantial thickness, for example, over 200 micrometers, or of minimum thickness less than 50 micrometers, provided there are no adverse affects on the final photoconductive device.

Any suitable hole blocking layer capable of forming an electronic barrier to holes between the adjacent photoconductive layer and the underlying conductive layer may be utilized. A hole blocking layer may comprise any suitable material. Typical hole blocking layers utilized for the negatively charged photoreceptors may include, for example, Luckamide, hydroxy alkyl methacrylates, nylons, gelatin, hydroxyl alkyl cellulose, organopolyphosphazines, organosilanes, organotitanates, organozirconates, silicon oxides, zirconium oxides, and the like. Preferably, the hole blocking layer comprises nitrogen containing siloxanes. Typical nitrogen containing siloxanes are prepared from coating solutions containing a hydrolyzed silane. Typical hydrolyzable silanes include 3-aminopropyl triethoxysilane, (N,N'-dimethyl 3-amino) propyl triethoxysilane, N,N-dimethylamino phenyl triethoxy silane, N-phenyl aminopropyl trimethoxy silane, trimethoxy silylpropyldiethylene triamine and mixtures thereof.

During hydrolysis of the amino silanes described above, the alkoxy groups are replaced with hydroxyl group. An especially preferred blocking layer comprises a reaction product between a hydrolyzed silane and the oxidized surface of an underlying conductive layer which inherently forms on the surface of conductive a metal layer when exposed to air after deposition. This combination reduces spots at time 0 and provides electrical stability at low RH. The imaging member is prepared by depositing on the conductive layer of a coating of an aqueous solution of the hydrolyzed silane at a pH between about 4 and about 10, drying the reaction product layer to form a siloxane film and applying electrically active layers, such as a photogenerator layer and a hole transport layer, to the siloxane film.

The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layers are preferably applied in the form of a dilute solution, with the solvent being removed after deposition of the coating by conventional techniques such as by vacuum, heating and the like. This siloxane coating is described in U.S. Pat. No. 4,464,450, the disclosure of thereof being incorporated herein in its entirety. After drying, the siloxane reaction product film formed from the hydrolyzed silane contains larger molecules. The reaction product of the hydrolyzed silane may be linear, partially crosslinked, a dimer, a trimer, and the like.

A preferred charge blocking layer may be fabricated from a solution of zirconium butoxide and gamma-amino propyl tri-methoxy silane in a suitable solvent such as anisisopropyl alcohol, butyl alcohol and water mixture. Generally, a preferred solution comprises between about 70 and about 90 by weight of zirconium butoxide and between about 30 and about 10 by weight of gamma-amino propyl tri-methoxy silane, based on the total weight of solids in the solution.

The blocking layer should be continuous and have a thickness of less than about 0.5 micrometer because greater thicknesses may lead to undesirably high residual voltage. A blocking layer of between about 0.005 micrometer and about 0.3 micrometer (50 Angstroms–3000 Angstroms) is preferred because charge neutralization after the exposure step is facilitated and optimum electrical performance is achieved. A thickness of between about 0.03 micrometer and about 0.06 micrometer is preferred for metal oxide layers for optimum electrical characteristics.

Any suitable undercoat layer may be applied to the charge blocking layer. Undercoat layer materials are well known in the art. Typical undercoat layer materials include, for example, polyesters, MOR-ESTER 49,000 (available from Morton International Inc.), Vitel PE-100, Vitel PE-200, Vitel PE-200D, and Vitel PE-222 (all Vitels available from Goodyear Tire and Rubber Co.), polyarylates (Ardel, available from AMOCO Production Products), polysulfone (available from AMOCO Production Products), polyurethanes, and the like. The MOR-ESTER 49000 polyester resin is a linear saturated copolyester reaction product of ethylene glycol with terephthalic acid, isophthalic acid, adipic acid and azelaic acid. Other polyester resins which are chemically similar to the 49000 polyester resin and which are also suitable for a photoreceptor undercoat layer coating include Vitel PE-100 and Vitel PE-200, both of which are available from Goodyear Tire & Rubber Co. An especially preferred undercoat layer material is a polyamide such as Luckamide 5003 from Dai Nippon Ink, Nylon 8 with methylmethoxy pendant groups, CM 4000 and CM 8000 from Toray Industries Ltd and other N-methoxymethylated polyamides, such as those prepared according to the method described in Sorenson and Campbell "Preparative Methods of Polymer Chemistry" second edition, pg 76, John Wiley and Sons Inc., 1968 and the like and the mixtures thereof. These polyamides can be alcohol soluble, for example, with polar functional groups, such as methoxy, ethoxy and hydroxy groups, pendant from the polymer backbone. Any suitable alcohol solvent or solvent mixtures may be employed to form a coating solution. Typical solvents include methanol, ethanol, propanol and mixtures thereof. Water may optionally be added to the solvent mixture. Satisfactory results may be achieved with a dry undercoat layer thickness between about 0.05 micrometer and about 0.3 micrometer. Conventional techniques for applying an undercoat layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infra red radiation drying, air drying and the like. In some embodiments, the undercoat layer functions as a blocking layer and there is no need for a separate blocking layer beneath the undercoat layer.

Photoconductive particles for charge generating binder layer such vanadyl phthalocyanine, metal free phthalocyanine, metal phthalocyanines, benzimidazole perylene, trigonal selenium, are especially sensitive to white light.

Any suitable polymeric film forming binder material may be employed as the matrix in the charge generating (charge generation) binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazole, and the like. These polymers may be block, random or alternating copolymers. The preferred binders for benzamidazole perylene pigment particles for adequate to good dispersion (of the pigment in the binder) are polyvinyl butyral (PVB) and poly (4,4'-diphenyl-1,1'-cyclohexane carbonate) (PCZ). However, although PVB is a good binder for applications employing drum substrates, PVB is not preferred for belt applications because it usually does not adhere as well to the other layers. PCZ is the preferred binder for belt applications. The choice of generator layer binder also determines the sensitivity and the shape of the Photo-induced Discharge Characteristics. One factor in this may be due to the solubility considerations of the transport layer molecule in the generator layer binder. The transport layer molecules diffuse into the generator layer during the transport layer coating. From the point of view of transport layer molecular solubility in the generator layer binder, PCZ is far superior to PVB.

Any suitable organic solvent may be utilized to dissolve the film forming binder. Typical solvents include n-butyl acetate, cyclohexanone, methyl ethyl ketone (MEK) and the like. The solvent n-butyl acetate is preferred because the dispersion quality of the coating mixture is superior. Coating dispersions for charge generating layer may be formed by any suitable technique using, for example, attritors, ball mills, Dynomills, paint shakers, homogenizers, microfluidizers, and the like.

The charge generation layer containing photoconductive pigments and the resinous binder material generally has a thickness of between about 0.1 micrometer and about 5 micrometers, and preferably has a thickness of between about 0.3 micrometer and about 2 micrometers. The charge generation layer thickness is related to binder content. Higher binder content compositions generally require thicker layers for photogeneration. Thicknesses outside these ranges can be selected providing the objectives of the present invention are achieved. Typical charge generating layer thicknesses have an optical density of between about 1.7 and about 2.1.

Any suitable and conventional technique may be utilized to mix and thereafter apply the charge generation layer coating mixture. Typical application techniques include slot coating, gravure coating, roll coating, spray coating, spring wound bar coating, dip coating, draw bar coating, reverse roll coating, and the like.

Any suitable drying technique may be utilized to solidify and dry the deposited coatings. Typical drying techniques include oven drying, forced air drying, infrared radiation drying, and the like.

The charge generation composition or pigment is present in the resinous binder composition in various amounts. Generally, however, from about 5 percent by volume to about 90 percent by volume of the charge generation pigment is dispersed in about 10 percent by volume to about 95 percent by volume of the resinous binder, and preferably from about 20 percent by volume to about 30 percent by volume of the charge generation pigment is dispersed in about 70 percent by volume to about 80 percent by volume of the resinous binder composition.

The charge generating layer of the photoreceptor of this invention preferably comprises a perylene pigment as a solution coated layer containing the pigment dispersed in a film forming resin binder. For photoreceptors utilizing a perylene charge generating layer, the perylene pigment is preferably benzimidazole perylene which is also referred to as bis(benzimidazole). This pigment exists in the cis and trans forms. The cis form is also called bis-benzimidazo(2,1-a-1', 1'-b) anthra (2,1,9-def:6,5,10-d'e'f') disoquinoline-6,11-dione. The trans form is also called bisbenzimidazo (2,1-a1', 1'-b) anthra (2,1,9-def:6,5,10-d'e'f') disoquinoline-10,21-dione. This pigment may be prepared by reacting perylene 3,4,9,10-tetracarboxylic acid dianhydride with 1,2-phenylene. Benzimidazole perylene compositions are well known and described, for example, in U.S. Pat. Nos. 5,019,473 and 4,587,189, the entire disclosures thereof being incorporated herein by reference. Benzimidazole perylene may be ground into fine particles having an average particle size of less than about 1 micrometer. Optimum results are achieved with a pigment particle size between about 0.2 micrometer and about 0.3 micrometer. Other suitable charge generation materials known in the art may also be utilized, if desired.

Any suitable charge transport layer containing the charge transport materials of this invention may be utilized on the charge generator layer. The active charge transport layer may comprise any suitable transparent organic polymer of non-polymeric material capable of supporting the injection of photo-generated holes and electrons from the charge generating layer and allowing the transport of these holes or electrons through the organic layer to selectively discharge the surface charge. The charge transport layer in conjunction with the generation layer in the instant invention is a material which is an insulator to the extent that an electrostatic charge placed on the transport layer is not conducted in the absence of activating illumination. Thus, the active charge transport layer is a substantially non-photoconductive material which supports the injection of photogenerated holes from the generation layer.

An especially preferred transport layer employed in one of the two electrically operative layers in the multilayer photoconductor of this invention comprises from about 25 to about 75 percent by weight of the charge transporting materials of this invention, and about 75 to about 25 percent by weight of a polymeric film forming resin in which the aromatic amine is soluble. A dried charge transport layer containing between about 40 percent and about 50 percent by weight of the charge transporting materials of this invention based on the total weight of the dried charge transport layer is preferred.

The charge transport materials preferably comprises an alkyl derivative of an aryl amine compound and an alkoxy derivative of an arylamine compound. Typical arylamine compounds include triphenyl amines, bis and poly triarylamines, bis arylamine ethers, bis alkyl-arylamines and the like.

One of the preferred charge transporting compounds in the charge transport layer are alkyl derivatives of arylamines capable of supporting the injection of photogenerated holes of a charge generating layer and transporting the holes through the charge transport layer. Typical charge transporting alkyl derivatives of arylamines include, for example, N,N'-bis(alkylphenyl)-[1,1'-biphenyl]-4,4'-diamine wherein the alkyl is, for example, methyl, ethyl, propyl, n-butyl and the like, N,N'-diphenyl-N,N'-bis(chlorophenyl)-[1,1'-biphenyl]-4,4'-diamine, N,N'-diphenyl-N,N'-bis(3"-methylphenyl)-(1,1'-biphenyl)-4,4'-diamine, and the like dispersed in an inactive film forming resin binder. Some of these charge transporting aromatic amines are represented by the formula:

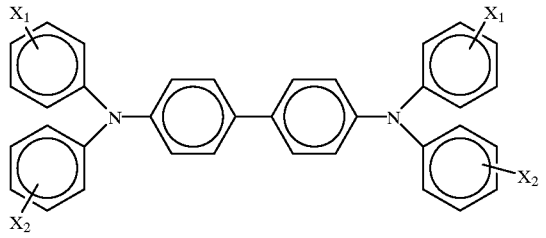

wherein $X_1$ and $X_2$ are independently selected from alkyl groups containing from 1 to 4 carbon atoms, or chlorine or hydrogen with at least one being alkyl or chlorine.

Although photoreceptor embodiments prepared with a charge generating layer comprising benzimidazole perylene dispersed in various types of film forming resin binders give reasonably good results, the sensitivity of the photoreceptor is found to be significantly improved, particularly, with the use of charge generating layers comprising benzimidazole perylene dispersed in poly(4,4'-diphenyl-1,1'-cyclohexane carbonate) (PCZ) when the charge transporting layer contains both an alkyl substituted diarylamine and an alkoxy substituted diarylamine or arylamine. Some of these alkoxy substituted diamines or amines are represented by the formula:

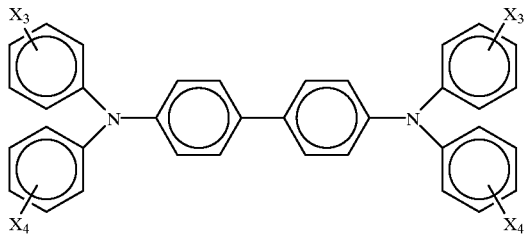

and or

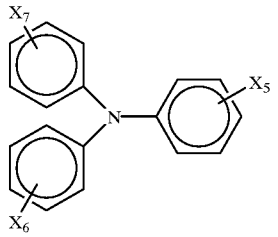

wherein $X_3$ is and $X_4$ are independently selected from the group consisting of $OCH_3$ and H with at least one being $OCH_3$, and $X_5$, $X_6$ and $X_7$ are independently selected from the group consisting of H and $OCH_3$ with at least one being an $OCH_3$ group.

Typical molecules represented by the above formulae include, for example, N,N'-diphenyl -N,N'bis[3-methoxyphenyl]-1,1'-biphenyl]-4,4'diamine, N,N'-diphenyl-N,N'bis[4-methoxyphenyl]-1,1'-biphenyl]-4,4'diamine, 4-methoxyphenyldiphenylamine, bis[4-methoxyphenyl] phenylamine, tris[4-methoxyphenyl]amine, and the like. For convenience, the expressions "diarylamine" and "arylamine" will frequently collectively be referred to herein as "arylamine".

The charge transport materials in the charge transport layer coating solution preferably comprise a major amount of a between about 30 percent by weight and about 50 percent by weight alkyl substituted diarylamine and a minor amount of between about 5 percent by weight and about 25 percent by weight alkoxy substituted arylamine, based on the total weight of solids in the coating solution.

Without being restricted by the theory, it is believed that a small fraction of the alkoxy containing amine or diamine migrates to the generator layer during fabrication of the transport layer and sensitizes the benzimidazole perylene in the charge generating layer. The amount of alkoxy containing amine or diamine that migrates to the generator layer varies depending upon the specific materials and proportions used in the charge transport layer coating solution. Since benzamidazole perylene is an extrinsic pigment, the photogeneration process within the generator layer requires the presence of transport layer molecules in the generator layer. The transport layer molecules migrate into the generator layer during the transport layer coating. An extrinsic pigment is one where photoabsorption within the pigment creates an exciton (a hole-electron pair) which dissociates into a free hole and an electron only when the transport molecules is present on the pigment surface. The choice of generator layer binder therefore determines the sensitivity and the shape of the Photo-induced Discharge Characteristics. One factor in this may be due to the solubility considerations of the transport layer molecule in the generator layer binder. The sensitization (increased sensitivity) with alkyloxy arylamine molecules in the transport layer must also mean that alkyloxy arylamine molecules migrate into the transport layer during the transport layer fabrication. A preferred method of sensitization is through transport layer doping. Generator layer doping of molecules through generator layer coating dispersions is not preferred since adding molecules into the generator layer coating dispersion may lead to changes in the dispersion quality. Migration of molecules during the transport layer coating process avoids changes in the dispersion quality of the generator layer coating dispersions and is easily employed as a quality control tool during the manufacturing process to obtain the desired sensitivity. From the point of view of transport layer molecular solubility in the generator layer binder, poly (4,4'-diphenyl-1,1'-cyclohexane carbonate) (PCZ) is superior to polyvinyl butyral (PVB).

Any suitable inactive film forming resin binder soluble in methylene chloride or other suitable solvent may be employed in the process of forming the charge transport layer of this invention. Typical inactive solvent soluble resin binders include, for example, polycarbonate resin, polyester, polyarylate, polyacrylate, polyether, polysulfone, and the like. Weight average molecular weights can vary, for example, from about 20,000 to about 1,500,000.

Preferred electrically inactive resin materials include polycarbonate resins have a weight average molecular weight from about 20,000 to about 120,000, more preferably from about 50,000 to about 100,000. The materials most preferred as the electrically inactive film forming resin material is poly(4,4'-dipropylidene-diphenylene carbonate) with a weight average molecular weight of from about 35,000 to about 40,000, available as Lexan 145 from General Electric Company; poly(4,4'-isopropylidene-diphenylene carbonate) with a weight average molecular weight of from about 40,000 to about 45,000, available as Lexan 141 from the General Electric Company; a polycarbonate resin having a weight average molecular weight of from about 50,000 to about 100,000, available as Makrolon from Farbenfabricken Bayer A. G., a polycarbonate resin having a weight average molecular weight of from about 20,000 to about 50,000 available as Merlon from Mobay Chemical Company and poly(4,4'-diphenyl-1,1'-cyclohexane carbonate) with a molecular weight of from about 35,000 to about 40,000, available as PCZ 400 available from Mitsubishi Chemical Co. Excellent results are achieved when the charge transport layer comprises N,N'-diphenyl-N,N'-bis(3-methylphenyl)-[1,1'-biphenyl]-4,4'-diamine and one or more of N,N'-diphenyl-N,N'bis[3-methoxyphenyl]-1,1'-biphenyl]-4,4'diamine, N,N'-diphenyl -N,N'bis[4-methoxyphenyl]-1,1'-biphenyl]-4,4'diamine, 4-methoxyphenyidiphenylamine, bis[4-methoxyphenyl] phenylamine, tris[4-methoxyphenyl]amine, in poly(4,4'-dipropylidene-diphenylene carbonate) binder.

Examples of photosensitive members having at least two electrically operative layers include the charge generator layer and diamine containing transport layer members disclosed in U.S. Pat. Nos. 4,265,990, 4,233,384, 4,306,008, 4,439,507. The disclosures of these patents are incorporated by reference herein in their entirety.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like. Generally, the thickness of the transport layer is between about 5 micrometers to about 100 micrometers, but thicknesses outside this range can also be used. A dried thickness of between about 18 micrometers and about 35 micrometers is preferred with optimum results being achieved with a thickness between about 20 micrometers and about 29 micrometers. Preferably, the charge transport layer comprises an arylamine small molecule dissolved or molecularly dispersed in a polycarbonate.

Other layers such as conventional ground strips comprising, for example, conductive particles disposed in a film forming binder may be applied to one edge of the photoreceptor in contact with the conductive surface or layer, blocking layer, adhesive layer or charge generating layer.

Optionally, an overcoat layer may also be utilized to improve resistance to abrasion. In some cases a back coating may be applied to the side opposite the photoreceptor to provide flatness and/or abrasion resistance. These overcoating and backcoating layers may comprise organic polymers or inorganic polymers that are electrically insulating or slightly semi-conductive.

The improved electrophotographic imaging members of this invention exhibit greater sensitivity. Further it is believed that diffusion of the alkoxy amine or diamine molecule from the transport layer causes this increase in sensitivity. The alkoxy containing amine or diamine molecule dopant in the transport layer does not cause any residual potential or cycle-up problems. Cycle-up is a phenomenon in which the residual potential keeps increasing with cycles.

PREFERRED EMBODIMENT OF THE INVENTION

The invention will now be described in detail with respect to the specific preferred embodiments thereof, it being understood that these examples are intended to be illustrative only and that the invention is not intended to be limited to the materials, conditions, process parameters and the like recited herein. All parts and percentages are by weight unless otherwise indicated.

EXAMPLE I

Several photoreceptors were prepared by forming coatings using conventional techniques on a substrate comprising vacuum deposited titanium layer on a polyethylene terephthalate film. The first coating was a siloxane barrier layer formed from hydrolyzed gamma-aminopropyltriethoxysilane having a thickness of 0.005 micrometer (50 Angstroms). The barrier layer coating composition was prepared by mixing 3-aminopropyltriethoxysilane (available from PCR Research Center Chemicals of Florida) with ethanol in a 1:50 volume ratio. The coating composition was applied by a multiple clearance film applicator to form a coating having a wet thickness of 0.5 mil. The coating was then allowed to dry for 5 minutes at room temperature, followed by curing for 10 minutes at 110° C. in a forced air oven. The second coating was an adhesive layer of polyester resin (49,000, available from E.I. duPont de Nemours & Co.) having a thickness of 0.005 micrometer (50 Angstroms). The second coating composition was applied using a 0.5 mil bar and the resulting coating was cured in a forced air oven for 10 minutes. The next coating was a charge generator layer of benzamidazole perylene (BzP) containing 40 percent by volume BzP, and 60 percent by volume of polycarbonate (PCZ) is coated on the adhesive layer. This photogenerating layer is prepared by introducing 0.45 grams PCZ and 50 mis of tetrahydrofuran into a 4 oz. amber bottle. To this solution is added 2.4 grams of BzP and 300 grams of ⅛ inch (3.2 millimeter) diameter stainless steel shot. This mixture is then placed on a ball mill for 72 to 96 hours. Subsequently, 2.25 grams of PCZ is dissolved in 46.1 gm of tetrahydrofuran, then added to this BzP slurry. This slurry is then placed on a shaker for 10 minutes. The resulting slurry is thereafter applied to the adhesive interface layer by using a ½ mil gap Bird applicator to form a coating layer having a wet thickness of 0.5 mil (12.7 micrometers). This photogenerating layer is dried at 125° C. for 1 minute in a forced air oven to form a dry photogenerating layer having a thickness of 1.0 micrometer.

COMPARATIVE EXAMPLE II

On the generator layer of one of the photoreceptors of Example I a transport layer of the prior art was coated. A charge transport layer solution was prepared by dissolving 1.2 grams of Makrolon® polycarbonate in 13 grams of methylene chloride. Added to this polymer solution was 1.2 gram of N,N'-diphenyl-N,N'-bis[3-methylphenyl]-[1,1'-biphenyl]-4,4'-diamine (TPD). After dissolution, the mixture was coated on the substrate containing the generator layer using a 3 mil Bird film applicator. The resulting film was dried in a forced air oven at 100° C. for 20 minutes to form a 25 micrometer thick dried layer of charge transport material.

EXAMPLE III

On the generator layer another of the photoreceptors of Example I, a transport layer of this invention was coated. A charge transport layer solution was prepared by dissolving 1.2 grams of Makrolon® polycarbonate in 13 grams of methylene chloride. Added to this polymer solution was one gram N,N'-diphenyl-N,N'-bis[3-methylphenyl]-[1,1'-biphenyl]-4,4'-diamine and 0.2 gram of N,N'-diphenyl-N,N'-bis[3-methoxyphenyl]-[1,1'-biphenyl]-4,4'-diamine. After dissolution, the mixture was coated on the substrate containing the generator layer using a 3 mil Bird film applicator. The film was dried in a forced air oven at 100° C. for 20 minutes to form a 25 micrometer thick dried layer of charge transport material.

EXAMPLE IV

On the generator layer of one of the photoreceptors of Example I, a transport layer of this invention was coated. A charge transport layer solution was prepared by dissolving 1.2 grams of Makrolon® polycarbonate in 13 grams of methylene chloride. Added to this polymer solution was 0.8 gram N,N'-diphenyl-N,N'-bis[3-methylphenyl]-[1,1'-biphenyl]-4,4'-diamine and 0.4 gram of N,N'-diphenyl-N,N'-bis[3-methoxyphenyl]-[1,1'-biphenyl]-4,4'-diamine. After dissolution, the mixture was coated on the substrate containing the CGL using a 3 mil Bird film applicator. The resulting film was dried in a forced air oven at 100° C. for 20 minutes to form a 25 micrometer thick dried layer of charge transport material.

EXAMPLE V

Electrical Scanning Test

Each photoreceptor device of Examples II, III and IV was mounted on a cylindrical aluminum drum substrate which was rotated on a shaft of a scanner. Each photoreceptor was charged by a corotron mounted along the periphery of the drum. The surface potential was measured as a function of time by capacitively coupled voltage probes placed at different locations around the shaft. The probes were calibrated by applying known potentials to the drum substrate. The photoreceptors on the drums were exposed by a light source located at a position near the drum downstream from the corotron. As the drum was rotated, the initial (pre-exposure) charging potential was measured by voltage probe 1. Further rotation leads to the exposure station, where the photoreceptor was exposed to monochromatic radiation of known intensity. The photoreceptor was erased by a light source located at a position upstream of charging. The measurements made included charging of the photoreceptor in a constant current or voltage mode. The photoreceptor was charged to a negative polarity corona. As the drum was rotated, the initial charging potential was measured by voltage probe 1. Further rotation lead to the exposure station, where the photoreceptor was exposed to monochromatic radiation of known intensity. The surface potential after exposure was measured by voltage probes 2 and 3. The photoreceptor was finally exposed to an erase lamp of appropriate intensity and any residual potential was measured by voltage probe 4. The process was repeated with the magnitude of the exposure automatically changed during the next cycle. The photodischarge characteristics were obtained by plotting the potentials at voltage probes 2 and 3 as a function of light exposure. The charge acceptance and dark decay were also measured in the scanner. The photoreceptors were then subjected to charge, discharge and erase cycles for 10,000 cycles and all the potentials were plotted to determine the cyclic stability. The sensitivity of the three devices are shown in Table I and the increases are considered very significant for devices employing benzamidazole perylene pigment.

TABLE I

| Device | TL dopant concentration | Ergs/cm$^2$ (800 to 200 V) | Ergs/cm$^2$ (800 to 100 V) |
|---|---|---|---|
| Example I | Control (0% dopant) | 8.16 | 11.28 |
| Example II | 8.5 wt. % | 7.92 | 11.06 |
| Example III | 17 wt. % | 7.47 | 10.41 |

The TL dopant in Examples II and III was N,N'-diphenyl-N,N'-bis[3-methoxyphenyl]-[1,1'-biphenyl]-4,4'-diamine.

The dopant concentration percentage was calculated based on the total weight of transport layer.

When cycled for 10,000 cycles there was no residual cycle-up in any of the three devices.

EXAMPLE VI

Devices as described in Examples III and IV were also fabricated wherein N,N'-diphenyl-N,N'-bis[3-methoxyphenyl]-[1,1'-biphenyl]-4,4'-diamine was replaced by N,N'-diphenyl-N,N'-bis[4-methoxyphenyl]-[1,1'-biphenyl]-4,4'-diamine, 4- methoxyphenyldiphenylamine, bis[4-methoxyphenyl]phenylamine, tris[4-methoxyphenyl] amine and tested as described in Example V. Sensivity increases in the range of 8 to 10 percent were observed. These increases are considered very significant for devices employing benzamidazole perylene pigment. When cycled for 10,000 cycles there was no residual cycle-up in any of these devices.

Although the invention has been described with reference to specific preferred embodiments, it is not intended to be limited thereto, rather those having ordinary skill in the art will recognize that variations and modifications may be made therein which are within the spirit of the invention and within the scope of the claims.

What is claimed is:

1. An electrophotographic imaging member comprising a flexible supporting substrate, an undercoat layer, a charge generating layer comprising benzimidazole perylene photoconductive pigment particles and poly(4,4'-diphenyl-1,1'-cyclohexane carbonate) film forming binder, and a charge transport layer formed from a coating solution, the coating solution comprising a polycarbonate film forming binder and charge transporting molecules, the charge transporting molecules comprising between about 30 percent by weight and about 50 percent by weight alkyl derivative of an arylamine selected from the group consisting of N,N'-bis(alkylphenyl)-[1,1'-biphenyl]-4,4'-diamine wherein the alkyl is selected from the group consisting of methyl, ethyl, propyl and n-butyl, N,N'-diphenyl-N,N'-bis (chlorophenyl)-[1,1'-biphenyl]-4,4'-diamine, N,N'-diphenyl-N,N'-bis(3"-methylphenyl)-(1,1'-biphenyl)-4,4'-diamine and a second transport molecule comprising between about 5 percent by weight and about 25 percent by weight alkyloxy derivative of an arylamine selected from the group comprising N,N'-diphenyl-N, N'bis[3-methoxyphenyl]-1,1'-biphenyl]-4,4'diamine, N,N'-diphenyl-N,N'bis[4-methoxyphenyl]-1,1'-biphenyl]-4,4'diamine, 4-methoxyphenyldiphenylamine, bis[4-methoxyphenyl]phenylamine, tris[4-methoxyphenyl]amine, and mixtures thereof, the percent by weight being based on the total weight of solids in the coating solution, the charge generating layer being located between the substrate and the charge transport layer.

2. A process for fabricating an electrophotographic imaging member comprising providing a flexible substrate, forming on the substrate an undercoat layer from a coating solution, forming a charge generating layer from a coating dispersion comprising benzimidazole perylene photoconductive pigment particles dispersed in a solution of poly(4,4'-diphenyl-1,1'-cyclohexane carbonate) film forming binder dissolved in a solvent for the binder, forming a charge transport coating from a coating solution comprising charge transporting molecules, the charge transporting molecules comprising between about 30 percent by weight and about 50 percent by weight alkyl derivative of an arylamine selected from the group consisting of N,N'-bis(alkylphenyl)-[1,1'-biphenyl]-4,4'-diamine wherein the alkyl is selected from the group consisting of methyl, ethyl, propyl and n-butyl, N,N'-diphenyl-N,N'-bis (chlorophenyl)-[1,1'-biphenyl]-4,4'-diamine, N,N'-diphenyl-N,N'-bis(3"-methylphenyl)-(1,1'-biphenyl)-4,4'-diamine and between about 5 percent by weight and about 25 percent by weight alkyloxy derivative of an arylamine selected from the group comprising N,N'-diphenyl-N,N'bis[3-methoxyphenyl]-1,1'-biphenyl]-4,4'diamine, N,N'-diphenyl-N,N'bis[4-methoxyphenyl]-1,1'-biphenyl]-4,4'diamine, 4-methoxyphenyldiphenylamine, bis[4-methoxyphenyl]phenylamine, tris[4-methoxyphenyl]amine, and mixtures thereof, the percent by weight being based on the total weight of solids in the coating solution, a polycarbonate film forming binder, solvent for the binder, and drying the coating to form a charge transport layer overlying the charge generating layer.

* * * * *